US011453979B2

(12) United States Patent
Luo et al.

(10) Patent No.: US 11,453,979 B2
(45) Date of Patent: Sep. 27, 2022

(54) PAPER STRENGTH IMPROVING COMPOSITION, MANUFACTURE THEREOF AND USE IN PAPER MAKING

(71) Applicant: Kemira OYJ, Helsinki (FI)

(72) Inventors: Yuping Luo, Atlanta, GA (US); Junhua Chen, Atlanta, GA (US); Zheng Dang, Atlanta, GA (US)

(73) Assignee: KEMIRA OYJ, Helsinki (FI)

( * ) Notice: Subject to any disclaimer, the term of this patent is extended or adjusted under 35 U.S.C. 154(b) by 0 days.

(21) Appl. No.: 17/055,152

(22) PCT Filed: May 14, 2018

(86) PCT No.: PCT/US2018/032504

§ 371 (c)(1),
(2) Date: Nov. 13, 2020

(87) PCT Pub. No.: WO2019/221692

PCT Pub. Date: Nov. 21, 2019

(65) Prior Publication Data

US 2021/0189659 A1 Jun. 24, 2021

(51) Int. Cl.

| | |
|---|---|
| ***D21H 17/43*** | (2006.01) |
| ***D21H 21/20*** | (2006.01) |
| ***D21H 17/49*** | (2006.01) |
| ***D21H 17/00*** | (2006.01) |
| ***D21H 23/04*** | (2006.01) |
| ***D21H 27/00*** | (2006.01) |

(52) U.S. Cl.
CPC ..... *D21H 21/20* (2013.01); *D21H 17/43* (2013.01); *D21H 17/49* (2013.01); *D21H 17/72* (2013.01); *D21H 23/04* (2013.01); *D21H 27/002* (2013.01)

(58) Field of Classification Search
CPC ..... D21H 17/49; D21H 17/55; D21H 21/20; D21H 17/52; D21H 17/375; D21H 17/41; D21H 23/04; D21H 19/54; D21H 19/24; D21H 17/28; D21H 27/002; D21H 17/72; D21H 17/43
USPC ..... 162/164.6
See application file for complete search history.

(56) References Cited

U.S. PATENT DOCUMENTS

| | | | |
|---|---|---|---|
| 5,427,652 | A | 6/1995 | Darlington et al. |
| 2006/0142432 | A1 | 6/2006 | Harrington et al. |
| 2009/0165978 | A1 | 7/2009 | Hagiopol et al. |
| 2013/0081771 | A1 | 4/2013 | Luo et al. |
| 2014/0158316 | A1 | 6/2014 | Luo et al. |

FOREIGN PATENT DOCUMENTS

| | | |
|---|---|---|
| WO | 1997030221 | 8/1997 |
| WO | 199806898 | 2/1998 |
| WO | 20130179139 | 12/2013 |
| WO | 2016085836 | 6/2016 |
| WO | 20160170232 | 10/2016 |

*Primary Examiner* — Mark Halpern
(74) *Attorney, Agent, or Firm* — Robin L. Teskin; Baker, Donelson, Bearman, Caldwell & Berkowitz, PC

(57) ABSTRACT

Embodiments of the present invention relate to a method of making a paper comprising the steps of: a) providing a cationic wet strength resin comprising a polyamidoamine epihalohydrin, a condensation copolymer of epihalohydrin and amine, or combination thereof; b) providing an anionic polymer; c) co-mixing the cationic wet strength resin and the anionic polymer to provide a composition comprising polyelectrolyte complexes; d) providing an aqueous pulp slurry, draining the aqueous pulp slurry on a screen to form a wet fiber web, and drying the wet fiber web to obtain the paper, wherein said co-mixed composition is introduced to the aqueous pulp slurry or on the formed wet fiber web. Embodiments of the present invention further relates to a paper wet strength composition, its use in paper making and a paper obtainable therefrom.

16 Claims, 2 Drawing Sheets

PAPER STRENGTH IMPROVING COMPOSITION, MANUFACTURE THEREOF AND USE IN PAPER MAKING

RELATED APPLICATIONS

This application is a U.S. National Phase application of International Application No. PCT/US2018/032504, filed May 14, 2018, which is incorporated herein by reference.

TECHNICAL FIELD

Embodiments of this disclosure relate to a method of improving strength of paper, and compositions used in paper and paper making.

BACKGROUND

It is well known to add different components to paper, usually during the paper-making process, to improve the strength of the resultant paper. Thus, dry strength and wet strength additives are widely added to the pulp suspension to provide improved strength to the paper product. For example, an untreated cellulose fiber web will typically lose 95-97% of its strength when saturated with water. Paper strength means a property of a paper material, and can be expressed, inter alia, in terms of dry strength and/or wet strength. Dry strength is the tensile strength exhibited by the dry paper sheet, typically conditioned under uniform humidity and room temperature conditions prior to testing. Wet strength is the tensile strength exhibited by a paper sheet that has been wetted with water prior to testing.

Additionally, it is important to find a good balance in the paper production to avoid overdosing of chemicals and avoiding chemical levels or combinations causing problems with repulping of the paper resulting in unusable materials and increased waste handling.

A common permanent wet strength additive is polyamidoamine epichlorohydrin (PAE). Wet strength PAE is often applied in rather high dosages which can cause many production operation issues. There is a limit to how much cationic PAE resin is absorbed onto the pulp.

Cationic PAE may be used as one additive in the paper making process; other additives of other charge, such as anionic additives may also be used. Compounds of different charges may disturb each other, and in order to ensure a proper effect of each compound, these are normally added separately in the paper-making process.

There are limitations for maximum amount of cationic polymer adsorbed e.g. on current kinds of cellulose fibers. The limitation (i.e. the fiber saturation point) depends on the level of fiber anionicity, the cationic charge density and the molecular weight of cationic polymers applied. An excess of cationic polymers added to the wet end of paper machine would change the zeta potential of fibers to cationic and the excess of cationic polymer could be lost to the white water when a sheet is formed in the paper machine thereby increasing risk of foaming, deposits etc. A typical example is the production of high wet strength paper towel, requiring high dosage levels of wet strength polyamidoamine-epichlorohydrin (PAE) resins (i.e.: >15 lb/ton) to achieve the required absolute high wet tensile specifications. Carboxymethyl cellulose (CMC) or anionic synthetic dry strength resins are often used as charge promoters on PAE wet strengthening paper machines to achieve higher absolute wet strength, potentially dry strength, which is not achievable by PAE alone.

There is a need to minimize the problems raised above and improve the overall production of papers. Consequently, a more cost-effective and easy-to-handle product is still highly desired by many paper producers.

There is a need for new ways of making paper to provide maintained or improved paper attributes such as strength, while improving the operation of the paper machine. It is also desirable to provide more environmentally friendly ways for production of paper.

SUMMARY

With the present invention it was discovered, contrary to a prejudice in the field of papermaking, that strength additives of opposite charge, and at least one of the strength additives being of reactive type, can be used in papermaking as a mixture, without the mixture becoming spoilt by precipitation or gelling, while obtaining also improved strength efficiencies compared to sequential addition of the strength additives.

Embodiments of the present invention provides a new method to enhance paper wet strength by creating a composition of polyelectrolyte complexes of a cationic wet strength resin and an anionic polymer. The complexes are pre-formed by co-mixing and may be provided in various mixing ratios, but preferably providing a net cationic charge to the composition. Without wishing to be bound by any theory it is believed that there is an increased inter-polymer network molecular weight and degree of polymeric structuring, so that the complexes are found to have a synergistic effect in paper wet strength development compared to adding the cationic wet strength resin and the anionic polymer sequentially at equal total resin dosages. The complexes are preferably generated on-site at paper mills by co-mixing the cationic wet strength resin with the anionic polymer, for instant use in the papermaking, to maximize the efficiency and avoid any stability issues such as precipitation or gelling which may appear over an extended storage time.

SHORT DESCRIPTION OF THE DRAWINGS

DETAILED DESCRIPTION

Figure 1:
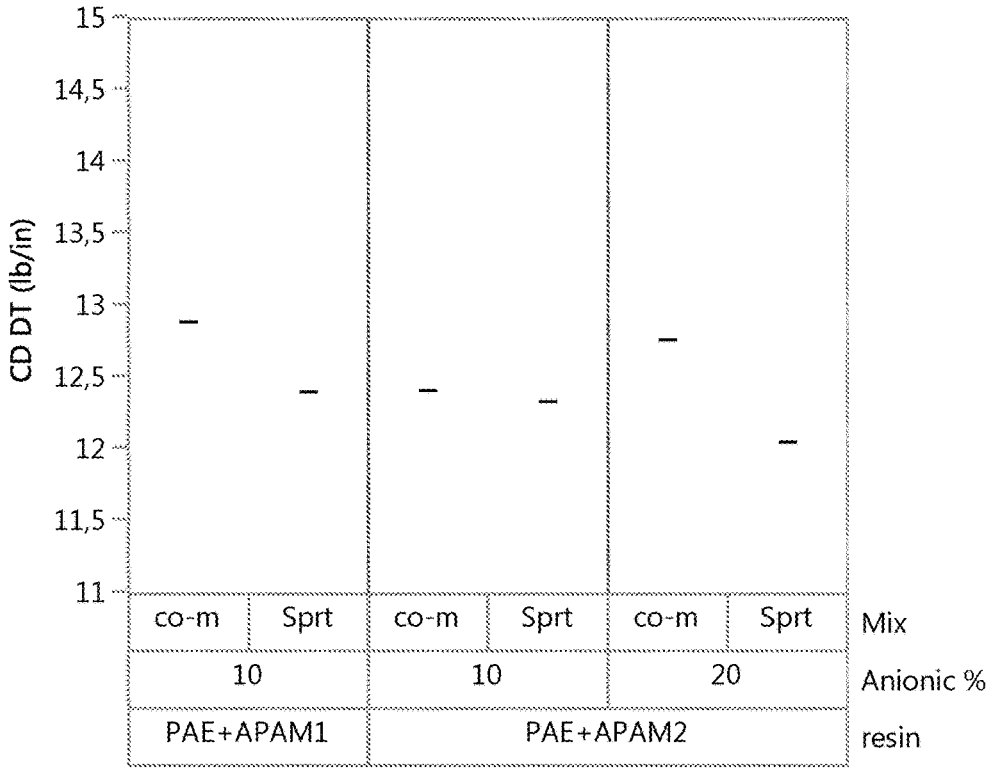
FIG. 1 shows a graph of the dry tensile strength cross-machine direction.

Embodiments of the present invention relates to co-mixing a cationic wet strength resin and an anionic polymer to provide a co-mixed wet strength composition comprising polyelectrolyte complexes prior to use in the papermaking.

When added to a papermaking process the mixture provided by co-mixing is an aqueous composition. It is to be noted that both of the mentioned components, i.e. the cationic wet strength resin and the anionic polymer are preferably provided as aqueous compositions, which then are co-mixed. The obtained aqueous co-mix composition may preferably be further diluted with water before feeding aqueous co-mixed composition into the papermaking process, e.g. into a fibre stock.

The papermaking process is a method of making paper products from pulp comprising providing an aqueous pulp slurry, draining the aqueous pulp slurry to form a wet fiber web, and drying the wet fiber web to obtain the paper. The steps of forming the papermaking pulp slurry, draining and drying may be carried out in any conventional manner.

Pulp slurry, which is used in paper making, is a mixture of pulp and water. The pulp slurry is prepared in practice using water, which can be partially or completely be recycled from the paper machine. It can be either treated or untreated white water or a mixture of such water qualities. The pulp slurry may contain interfering substances (e.g., fillers).

Paper is a sheet material that contains pulp fibers, and may also contain other materials. Suitable pulp fibers include natural and synthetic fibers, used either alone on in combination. For example, the pulp fibers may comprise cellulosic fibers, wood fibers of all varieties used in papermaking, other plant fibers, such as cotton fibers, or fibers derived from recycled paper or broke. The synthetic fibers may comprise rayon, nylon, fiberglass, or polyolefin fibers.

The present method of making a paper comprises the steps of:

a) providing a cationic wet strength resin comprising a polyamidoamine epihalohydrin, a condensation copolymer of epihalohydrin and amine, or combination thereof, b) providing an anionic polymer, c) co-mixing the cationic wet strength resin and the anionic polymer to provide a composition comprising polyelectrolyte complexes, d) providing an aqueous pulp slurry, draining the aqueous pulp slurry, e.g. on a screen, to form a wet fiber web, and drying the wet fiber web to obtain the paper, wherein said co-mixed composition is introduced to the aqueous pulp slurry or on the formed wet fiber web.

The on-site co-mixing of the components provides process simplicity as only one composition is injected into the process instead of arranging two separate injection sites. Additionally addition of the on-site co-mixed composition comprising the cationic wet strength resin and the anionic polymer provides increased paper wet strength efficiency compared to sequential addition of the same components. More specifically an increased immediate wet strength and/or increased permanent wet strength may be obtained, as well as an increased dry strength, compared to sequential addition of the components, at equal total polymer dosages. It is believed that the co-mixing approach increases the molecular weight of the inter-polymer network of the polyelectrolyte complexes as well as degree of structuring, that may assist in retaining the components to the fibers, so that the complexes provide synergistic effect in paper strength development compared to sequential addition of the same components. This means that desired paper strength specifications may be met by lower strength additive dosage providing cost savings. As the strength additives are used more efficiently to strength development, the amount of strength additives not retained in the fiber web is lower, meaning lower resin load in the circulating waters, decreased foaming, and lower risk of deposits and felt plugging.

Conventional approaches to improve retention of cationic wet strength resins on fibers include using fiber materials having higher anionic charge and thus higher affinity towards cationic wet strength resins, and increasing refining level of the fibers, thereby increasing the available surface area for adsorption of the wet strength resin. However these approaches are not available or desirable in all situations. For example, recycle fiber content has increased as a fiber source in the papermaking. However fibers that have undergone several rounds of recycling have decreased anionic charge as well as decreased intrinsic fiber strength, so further refining does not increase the available surface area but only decreases fiber length and thus paper strength. Even when using fiber material that responds to increased refining, it may be undesired as higher refining slows down the drainage rate. Also use of anionic strength polymers may lead to a decrease in the drainage rate, so finding a strength additive concept meeting paper strength specifications with lower dosage of anionic strength polymers is desirable.

The on-site co-mixing approach provides flexibility as the ratio of the two components may be easily adjusted to match for example variance in pulp properties. The on-site co-mixing approach provides also optimal performance as the co-mixed composition comprising the polyelectrolyte complexes is freshly made, so performance losses due to precipitates or gelling in the composition may be avoided.

The cationic wet strength resin comprises either a polyamidoamine epihalohydrin, or a condensation copolymer of epihalohydrin and amine, or it may also comprise or be a combination of the two.

Condensation copolymers of epihalohydrin and amine, usable as wet strength resins, are well known in the art. The amine may be a polyamine like a simple diamine such as ethylene diamine or comprise more than two amine functionalities such as diethylene triamine, triethylenetetramine, tetraethylene pentamine, bishexamethylene triamine, polyethylenimine, polyallylamine, polydiallylamine, polyvinylamine, and the like. Typically the epihalohydrin is epichlorohydrin.

Also polyamidoamine epihalohydrins, usable as wet strength resins, are well known in the art. The polyamidoamine may be selected from reaction products of a diacid and a polyamine, such as those mentioned above. The diacid may be selected from malonic acid, succinic acid, glutaric acid, adipic acid, suberic acid, sebacic acid, and any combination thereof. Typically the diacid is a saturated aliphatic dibasic carboxylic acid, often containing 3-10 carbon atoms. Typically the diacid is a dicarboxylic acid containing 4-8 carbon atoms such as adipic acid, or glutaric acid. The polyamidoamine may be then reacted with an epihalohydrin to obtain cationic wet strength polyamidoamine epihalohydrin resin. Typically the epihalohydrin is epichlorohydrin.

By polyamidoamine epihalohydrin wet strength resin is meant a polyamidoamine epihalohydrin prepared by reacting epihalohydrin with polyamidoamine, using epihalohydrin in a molar excess to secondary amines of the polyamidoamine, e.g. in a molar ratio of at least 0.80 of epihalohydrin to secondary amines.

Typically the cationic wet strength resin is in the form of an aqueous solution. It may be further diluted before co-mixing with the anionic polymer. Optimally the solids content of the cationic wet strength resin is at least 15 weight-%, such as 15 to 30 weight-%, before co-mixing with the anionic polymer. Typically the higher the solids content, the higher the viscosity of the composition. When using the preferred solids content the interaction between the cationic wet strength resin and the anionic polymer may be improved, while the composition has a viscosity that is still easy to handle and mix. Typically also the anionic polymer is in the form of an aqueous solution, for example anionic polymer available as a solution polymerization product, or prepared by dissolving dry anionic polymer into water, or in any other way. The anionic polymer may be further diluted before co-mixing with the cationic wet strength resin.

Alternatively, the provided co-mixed composition comprising the cationic wet strength resin and the anionic polymer, may be further diluted e.g. with water, before addition into a papermaking process.

In one embodiment the composition comprising the polyelectrolyte complexes consists essentially of the cationic wet strength resin and the anionic polymer as sole polymeric constituents.

The anionic polymer may comprise an anionic polymer of single type, or blend of various anionic polymers. In one embodiment the anionic polymer comprises an anionic synthetic polymer, an anionic polysaccharide, or any combination thereof.

The anionic synthetic polymer may comprise a copolymer of non-ionic monomers and anionic monomers, a homopolymer of anionic monomers, a partially or completely hydrolysed poly(meth)acrylamide, an anionic glyoxalated polyacrylamide, or any combination thereof. In one embodiment the anionic synthetic polymer comprises a copolymer of (meth)acrylamide and anionic monomers.

As used herein, by anionic polymer is meant a polymer or combination of polymers having net anionic charge, measured at pH 7. In other words the copolymer of non-ionic monomers and anionic monomers may also comprise units originating from cationic monomers, provided that their amount is so low that the net charge of the copolymer is anionic.

By a copolymer of non-ionic monomers and anionic monomers is meant a copolymer of these monomers and optionally small amount of cationic monomers, or a copolymer obtained by polymerizing non-ionic monomers followed by derivatization such as sulfomethylation into an anionic copolymer.

The anionic monomers may be selected from the group consisting of acrylic acid, methacrylic acid, acrylamidomethylpropanesulfonic acid, acryamidomethylbutanoic acid, maleic acid, fumaric acid, itaconic acid, vinyl sulfonic acid, styrene sulfonic acid, vinyl phosphonic acid, allyl sulfonic acid, allyl phosphonic acid, sulfomethylated acrylamide, phosphonomethylated acrylamide, and any combination thereof. By referring to the acid form of the anionic monomers, it is also meant to cover any water soluble alkali metal salt thereof, any alkaline earth metal salt thereof, and ammonium salt thereof.

By a homopolymer of anionic monomers is meant a polymer obtained by polymerizing for example any of the above listed anionic monomers.

By a partially or completely hydrolysed poly(meth)acrylamide is meant a polymer obtained by polymerizing (meth) acrylamide monomers to obtain a poly(meth)acrylamide followed by a partial acid or alkali hydrolysis of the poly (meth)acrylamide.

The anionic synthetic polymer may comprise also a branching agent such as N,N'-methylenebisacrylamide (MBA). Also chain transfer agents and/or other conventional polymerization additives may be used in the preparation of the anionic synthetic polymers.

The anionic polysaccharide may comprise anionic versions of cellulose-based polysaccharides, alginate-based polysaccharides, vegetable gum based polysaccharides, starch-based polysaccharides, or any combinations thereof.

The anionic cellulose-based polysaccharides may comprise oxidized celluloses, phosphorylated cellulose, carboxymethylated cellulose, anionic microfibrillar cellulose, or any combination thereof. The anionic cellulose-based polysaccharides or anionic celluloses disclosed herein may be provided in the form of anionic microfibrillar cellulose. Herein anionic microfibrillar cellulose is to be interpreted as any anionic fibrillar cellulose having at least one dimension in nano or micro scale.

Anionic carboxymethylated cellulose may comprise carboxymethylcellulose (CMC), carboxymethylhydroxyethylcellulose (CMHEC), carboxymethyl methyl cellulose (CMMC), or any combination thereof. As mentioned above the, carboxymethylated cellulose may be in the form of microfibrillar cellulose.

In this context by anionic microfibrillar cellulose is meant any anionic fibrillar cellulose having at least one dimension in nano or micro scale.

Anionic vegetable gum based polysaccharides may comprise anionic guar gum, anionic locust bean gum, anionic karaya gum, or any combination thereof. Anionic guar-based polysaccharides may be selected from the group consisting of carboxymethylhydroxypropyl guar (CMHPG), carboxymethyl guar (CMG), and any combinations thereof.

Anionic starch-based polysaccharides may comprise oxidized starch, phosphorylated starch, carboxymethylated starch, or any combinations thereof.

The anionic polysaccharide may comprise anionic cellulose such as carboxymethylcellulose (CMC), anionic starch, anionic vegetable gum, anionic microfibrillar cellulose, or any combination thereof. These are widely available strength polymers having suitable anionic charge and molecular weight for strength development.

The anionic polymer may have a charge density of about −0.1 to −10 meq/g (dry), such as about −0.7 to −2.0 meq/g (dry), as measured at pH 7.

The charge densities may be measured for example by charge titration using Mütek PCD.

When the anionic polymer comprises a copolymer of non-ionic monomers and anionic monomers, said copolymer may have a molar ratio of anionic monomer to non-ionic monomer in the range of 5:95-95:5, such as in the range of about 5:95 to 15:85. The latter embodiment provides lower anionic charge density to the anionic polymer and thereby the anionic polymer may have higher molecular weight still not causing precipitation or gelling even if longer delay between co-mixing and use in the paper making.

The anionic polymers may have a standard viscosity of about 1.1 to 6 cP, such as about 1.1 to 3.5 cP, or 1.2 to 2.5 cP, measured at 0.1 weight-% polymer concentration in 1 M NaCl, at 25° C. and pH 8.0-8.5, using Brookfield DVII T viscometer. The weight average molecular weight of such anionic polymers may be in the range of about 100 000 to 10 000 000 Da, or even higher, such as about 100 000 to 5 000 000 Dalton, or about 500 000 to 2 000 000 Dalton. In some embodiments, for example when using anionic polymer having higher anionic charge density, such as a homopolymer of anionic monomers or a copolymer of non-ionic monomers and relatively high amount of anionic monomers, such as at least 30 mol-%, a preferred standard viscosity of the anionic polymer may be less than 1.1 cP, measured at 0.1 weight-% polymer concentration in 1 M NaCl, at 25° C. and pH 8.0-8.5, using Brookfield DVII T viscometer, as this may provide longer delay between the co-mixing and the introduction to the aqueous pulp slurry or on the formed wet fiber web without precipitation or gelling. For optimal wet strength development however, a higher standard viscosity, indicating higher average molecular weight, of at least 1.1 cP, measured at 0.1 weight-% polymer concentration in 1 M NaCl, at 25° C. and pH 8.0-8.5, using Brookfield DVII T viscometer, is preferred, as it may provide higher molecular weight and degree of structure to the polyelectrolyte complexes. For optimal wet strength development allowing also longer delay between the co-mixing and the introduction to the aqueous pulp slurry or on the formed wet fiber web without precipitation or gelling, the preferred standard viscosity of the anionic polymer may be about 1.1 to 3.5 cP, such as about 1.2 to 2.5 cP, measured at 0.1 weight-% polymer concentration in 1 M NaCl, at 25° C. and pH 8.0-8.5, using Brookfield DVII T viscometer.

The anionic polymer may have any pH or be adjusted to a pH between 1.0 and 12.

The cationic wet strength resin may have a weight average molecular weight of about 150 000 to 1 000 000 Dalton, such as about 500 000 to 1 000 000 Dalton. The weight average molecular weight in the range of 150 000 to 500 000 Dalton is typical for condensation copolymers of epihalohydrin and amines, while weight average molecular weight in the range of 500 000 to 1 000 000 Dalton is typical for polyamidoamine epihalohydrin resins. The benefit of cationic wet strength resin having lower molecular weight is that the delay between the co-mixing and the introduction to the aqueous pulp slurry or on the formed wet fiber web may be longer without precipitation or gelling of the co-mixed composition, even when co-mixed with anionic polymer having higher anionic charge density and/or higher standard viscosity value indicating a higher molecular weight. The cationic wet strength resin having higher molecular weight is expected to provide more pronounced strength development. The weight average molecular weight may be calculated e.g. from molecular weight distribution data determined by Size Exclusion Chromatography, or obtained by GPC.

The compositions comprising the polyelectrolyte complexes formed by co-mixing should be stable, i.e. without substantial precipitation or gelling, prior to the optional dilution with dilution water and pumping to the paper machine.

The cationic wet strength resin may have a charge density of about 1.5 to 6.0 meq/g, as measured at pH 4, such as about 1.5 to 4.0 meq/g.

The cationic wet strength resin may comprise a polyamidoamine epihalohydrin resin, such as a polyamidoamine epichlorohydrin resin. The cationic wet strength resin may be a polyamidoamine epihalohydrin resin, such as a polyamidoamine epichlorohydrin resin.

The polyamidoamine epihalohydrin resin may have an epihalohydrin:amine molar ratio of at least 0.80, such as in the range of 0.85:1.4, or in the range of 0.90 to 1.3. More specifically the polyamidoamine epihalohydrin resin may have an epihalohydrin:amine molar ratio of at least 0.80, such as in the range of 0.85:1.4, or in the range of 0.90 to 1.3. These embodiments have the benefit of providing higher reactivity compared to lower molar ratios, and lower amounts of undesirable chlorinated by-products compared to higher molar ratios.

The weight ratio of the anionic polymer to the cationic wet strength resin may be about 5:95 to 50:50, such as 5:95 to 40:60, 10:90 to 30:70, or 10:90 to 20:80.

The co-mixed composition of step c) may be diluted with water before introducing to the aqueous pulp slurry or on the formed wet fiber web, preferably to a solids content of at most 5 weight-%, such as 0.5-4 weight-%, or 1-3 weight-%.

The composition comprising polyelectrolyte complexes, i.e. the co-mixed composition, may have a net cationic charge, as measured at pH 4, preferably the charge density is at least 0.01 meq/g, such as in the range of 0.1 to 3.0 meq/g, as measured at pH 4. Co-mixed compositions having cationic charge of at most 3.0 meq/g, as measured at pH 4, provide better control to the dosing, and over-cationization of the process and excessive foaming is easier to avoid. Additionally these charge density values provide a good retention of the net cationic complexes to the cellulosic fibres, however without extensive flocculation of the fibers.

The composition comprising polyelectrolyte complexes is to be forwarded to an aqueous pulp slurry or on a formed wet fiber web within a reasonable time frame after co-mixing, as the composition is meant for instant use at the paper mill after the co-mixing step. By instant use at the paper mill is meant time period of at most a couple of hours to maintain the composition substantially free from precipitates or gelling. In one embodiment the co-mixed composition is introduced to the aqueous pulp slurry or on the formed wet fiber web at most 2 hours after initiation of co-mixing, such as at most 30 minutes or at most 2 minutes after initiation of co-mixing. This time frame includes the mixing procedure as well as the transport to provide the co-mixed composition to the fibers at a stage of the paper making process. The latter delay time provides a further benefit that no additional storage tank is needed for keeping the co-mixed composition. According to a more preferred embodiment the delay time is at most 1 min, providing the same effect and requiring even shorter pipeline between co-mixing and introduction to the aqueous pulp slurry or on the formed wet fiber web. The time period for the co-mixing procedure and until introduction of the co-mixed composition to the aqueous pulp slurry or on the formed wet fiber web may be about 15 seconds to 5 minutes after co-mixing, such as 0.5-2 minutes, 0.5-1 minute, i.e. the time frame for the co-mixed composition to be introduced to the aqueous pulp slurry or on the formed wet fiber web after initiation of the co-mixing.

The co-mixed composition may be introduced to the aqueous pulp slurry at any point of the paper making process, for example to a thick stock or to a thin stock. The co-mixed composition may be introduced on the formed wet fiber web at any point after formation and before dryer section, for example using a spraying bar, size press or any other conventional application equipment.

In one embodiment the method includes forming compositions having polyelectrolyte complexes designed to provide optimal strength performance wherein multiple polymers such as anionic and cationic polymers are used that respond to various mixing ratios such that a unique polymer structure or distribution of molecular weights are achieved at any point for other applications. A combination of multiple anionic polymers and either cationic wet strength resins, or a combination with a cationic wet strength resin and at least another cationic polymer may provide specific polymer complexes suitable to address specific production issues.

The present invention also relates to a paper wet strength composition for instant use at a paper mill, the composition consisting essentially of a cationic wet strength resin comprising a polyamidoamine epihalohydrin, a condensation copolymer of epihalohydrin and amine, or a combination thereof, an anionic polymer, and water, co-mixed on-site at the paper mill to provide a composition comprising polyelectrolyte complexes.

The components used in the paper wet strength composition may have the features disclosed above for the present process.

The paper wet strength composition may have a weight ratio of the anionic polymer to the cationic wet strength resin of about 5:95 to 50:50, such as 5:95 to 40:60, or 10:90 to 30:70, as indicated above.

The composition may, as indicated above, have a net cationic charge as measured at pH 4. The charge density may be at least 0.01 meq/g, such as in the range of 0.1 to 3.0 meq/g, as measured at pH 4.

The present invention also relates to use of the present paper wet strength composition in paper making.

The present invention also relates to a paper having improved wet strength manufactured by the method using the present paper strength composition.

The co-mixed composition may be used in the manufacture of all paper grades requiring or benefiting from wet strength development. Such paper grades include those becoming wetted during end-use, and those being wetted e.g. by coating or gluing solution during processing of the paper. By paper is meant to cover any single or multi ply paper product structures.

The paper may be selected from tissue, towel, carrier board, linerboard, fluting, liquid packaging board, folding box board, solid bleached sulfate board, solid unbleached sulfate board, and white lined chipboard, as these paper grades benefit most from the co-mixed strength composition of the invention.

The present method shows benefits such as by co-mixing effectively a reduced net cationic charge wet strength resin is obtainable, enhancing retention of the cationic wet strength resin on sheet and allowing machines to continually load wet strength resins to achieve higher absolute wet strength targets without over-cationizing the wet end system. By dosing the co-mixed strength composition a lower change in zeta potential is provided compared to dosing of cationic wet strength resin alone, which may be beneficial for example for fiber stocks having low anionic charge, such as recycled fiber stocks. Further, by adding the complexes to the fibres before sheet formation better strength increase is provided compared to separate sequential addition mode at equal total resin dosages. Addition on a formed wet fiber web may provide even higher retention of the polyelectrolyte complexes to the fiber web and thus even higher increase in surface strength. It is to be noted that even greater synergistic effects of co-mixing may be achieved by using an extra high weight average molecular weight anionic polymer with the cationic wet strength resin, such as polyamidoamine epichlorohydrin. Also, co-mixing on site is flexible. A user may easily alter ratios to meet specific strength and retention/drainage requirements for different paper machines and for pulp slurries of different properties.

The embodiments of the present disclosure described in this specification may be combined, in whole or in part, with each other. Even several of the embodiments may be combined, in whole or in part, together to form a further embodiment of the present disclosure. Further, the particular features or characteristics described in this specification may be combined in any suitable manner in one or more embodiments. Thus, the particular features or characteristics illustrated or described in connection with various embodiments may be combined, in whole or in part, with the features or characteristics of one or more other embodiments without limitation. Such modifications and variations are intended to be included within the scope of the present disclosure. A method, a composition, use of a composition or paper, to which the present disclosure is related, may comprise at least one of the embodiments, features or characteristics of the present disclosure described in this specification. All embodiments disclosed herein may be used in any combination(s).

In the following, the present disclosure will be described in more detail with reference to the accompanying figures. The description below discloses some embodiments and examples of the present disclosure in such detail that a person skilled in the art is able to utilize the present disclosure. Not all steps of the embodiments are discussed in detail, as many of the steps will be obvious for the person skilled in the art based on this specification.

EXAMPLES

Determination of Polymer Standard Viscosity

The standard viscosity is used to indicate the molecular weights for polymers having relatively high molecular weight. Standard viscosity was determined with a Brookfield DVII T viscometer. The 0.2 weight-% water solution of polymer is diluted to 0.1 weight-% concentration with 11.7 weight-% NaCl solution to make a 50:50 solution of polymer and 11.7 weight-% NaCl in a 250 mL beaker, i.e. 0.1 weight-% polymer concentration in 1 M NaCl. Then, pH of the 0.1 weight-% salt dilute polymer solution is adjusted to pH 8.0-8.5 by dilute NaOH solution or $H_2SO_4$ solution before the viscosity measurement.

Measurement of Charge Density

Charge density was determined at the specified pH, such as at pH 7.0, by charge titration, using polyethylene sulfonate solution as titrant and using Mütek PCD-03 for end point detection. pH of the polymer solution was adjusted to the specified pH with 10 weight-% aqueous sodium hydroxide solution or with 10 weight-% aqueous sulphuric acid solution before the charge density determination. The measured charge densities are presented as meq/g dry material.

1.1. Preparation of the Chemicals

A cationic wet strength resin, polyamidoamine epichlorohydrin (PAE) having epi:amine molar ratio of about 1.25:1 and a weight average molecular weight of about 600-800 kDa, and an anionic polymer, copolymer of acrylamide and acrylic acid, APAM1 or APAM2, were co-mixed for 2 minutes to provide two neat co-mixed polymer compositions at a desired ratio. APAM1 had a standard viscosity of about 1.5 cP and charge density of −2.2 meq/g (measured at pH 7) and APAM2 had a standard viscosity of about 1.25 cP and charge density of −1.2 meq/g (measured at pH 7). The obtained co-mixed compositions were then diluted to a concentration of about 1-2 weight-%, as dry solids of the diluted blend (named "co-m" in the figures).

The same cationic wet strength resin and anionic polymer APAM2 were also provided as separate chemicals and added sequentially to the aqueous pulp slurry during the paper making (named "Sprt" in the figures). The amount of anionic polymer used in the tests was either 10 or 20 wt %, of the total solids of the composition (indicated as "Anionic %" in the figures).

1.2. Handsheet Procedure

A handsheet study was conducted using blend bleached Kraft pulp with 50/50 softwood/hardwood. Prior to the handsheet preparation, the thick stock was diluted to about 0.5% with deionized (DI) water treated with 150 ppm sulfate ion and 35 ppm calcium ion. The pH value of the diluted stock was 6.8 to 6.9 during the handsheets making. The basis weight of the handsheets was approximately 70 g/m$^2$ (i.e. 50 lbs/3472 ft$^2$).

A Dynamic Sheet Former was used to prepare the handsheets according to the standard protocol. Sheets were pressed at 15 psi (about 103 kPa) and drum dried for 60 seconds. The sheets were post cured for 15 minutes at 105° C. Prior to the paper physical testing, the paper sheets were conditioned at least overnight at 73° F. and 50% relative humidity. This follows the TAPPI T 402 om-93, Standard Conditioning and Testing Atmospheres for Paper, Board, Pulp hand sheet, and Related Products method.

1.3. Tensile Strength, Dry

Tensile strength is measured by applying a constant rate-of-elongation to a sample and recording three tensile breaking properties of paper and paper board: 1) the force per unit width required to break a specimen (tensile strength), 2) the percentage elongation at break (stretch), and 3) the energy absorbed per unit area of the specimen before breaking (tensile energy absorption). Only the dry tensile strength measurement is reported. This method is applicable to all types of paper, but not to corrugated board. This procedure references TAPPI Test Method T494. Twelve measurements were taken per condition and standard deviations were reported. A Thwing-Albert QC3A Series tensile tester was used for this study.

1.4. Tensile Strength, Immediate Wet

This test method is used to determine the wet tensile strength of paper and paperboard immediately after deionized water is brushed onto both sides of a paper sample. The wet tensile breaking strength is useful in the evaluation of the performance characteristics of tissue products, paper towels, bags and other papers subjected to stress during processing or use while wet. This method references TAPPI TEST Method T456. Eight measurements were taken per condition and averages were reported. A Thwing-Albert QC3A tensile tester was used.

1.5. Tensile Strength, 30 Min Soak

Tensile strength is measured by wetting the sample strips in the deionized water for 30 minutes, removing excess water from the specimen, and then applying a constant rate-of-elongation to a specimen and recording the force per unit width required to break a specimen. This is the tensile strength, which is the maximum tensile stress developed in the test specimen before rupture. This method is applicable most commonly on paper towel and paper board. This procedure references TAPPI Test Method T456. Eight measurements were taken per condition. A Thwing-Albert QC3A tensile tester was used.

1.6. Zeta Potential

Zeta potential is defined as the electric potential at slipping plane (plane of shear), within which counter ions bound to the particle move with the particle and outside of which counter ions are free to move independently. Colloids with high zeta potential (negative or positive) are electrically stabilized, while colloids with low zeta potentials tend to coagulate. A Mütek SZP-06 System Zeta Potential analyzer was used to measure the streaming potential of pulp suspensions. Samples are sucked into the suction tube by applying a vacuum pressure and formed into a pad of fibers in the measuring cell. The flow past the fiber pad shears off counter ions, thus generating a streaming potential. Zeta potential is calculated by using the measured streaming potential, conductivity, pressure differential, viscosity and dielectric constant of the liquid phase. It is reported in millivolts (mV).

2. Results and Discussions

From the figures it is clearly found that co-mixing and increasing the amount of anionic polymer improves the tensile strengths and Zeta potential, respectively.

Figure 2:
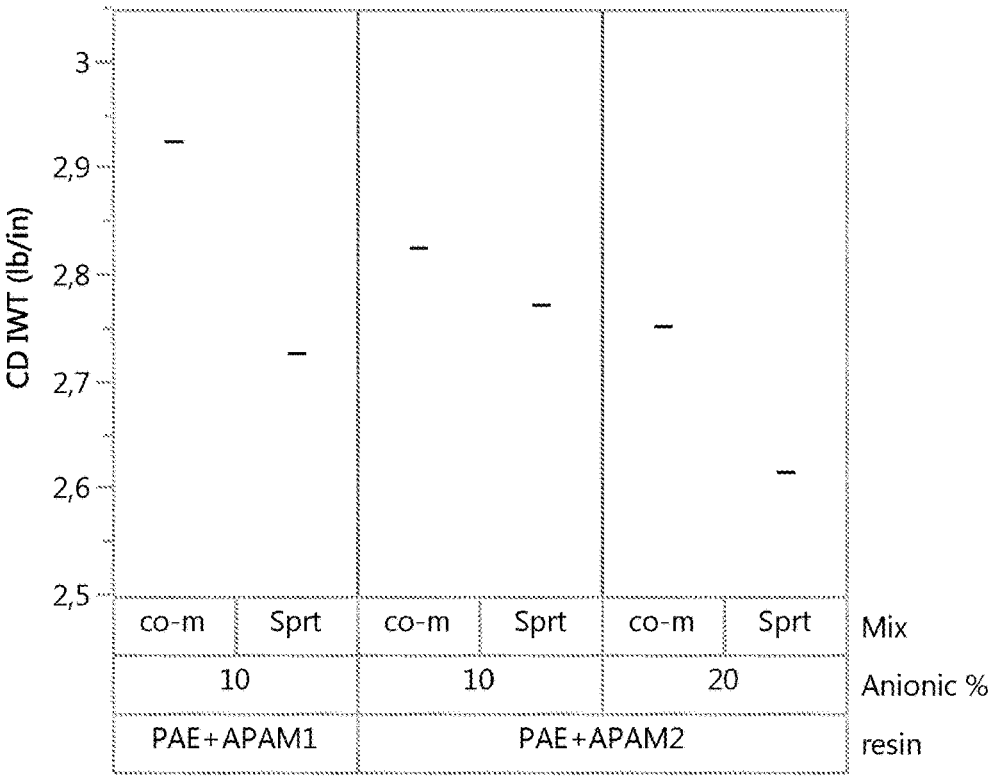
FIG. 2 shows a graph of the immediate wet tensile strength cross-machine direction.
Figure 3:
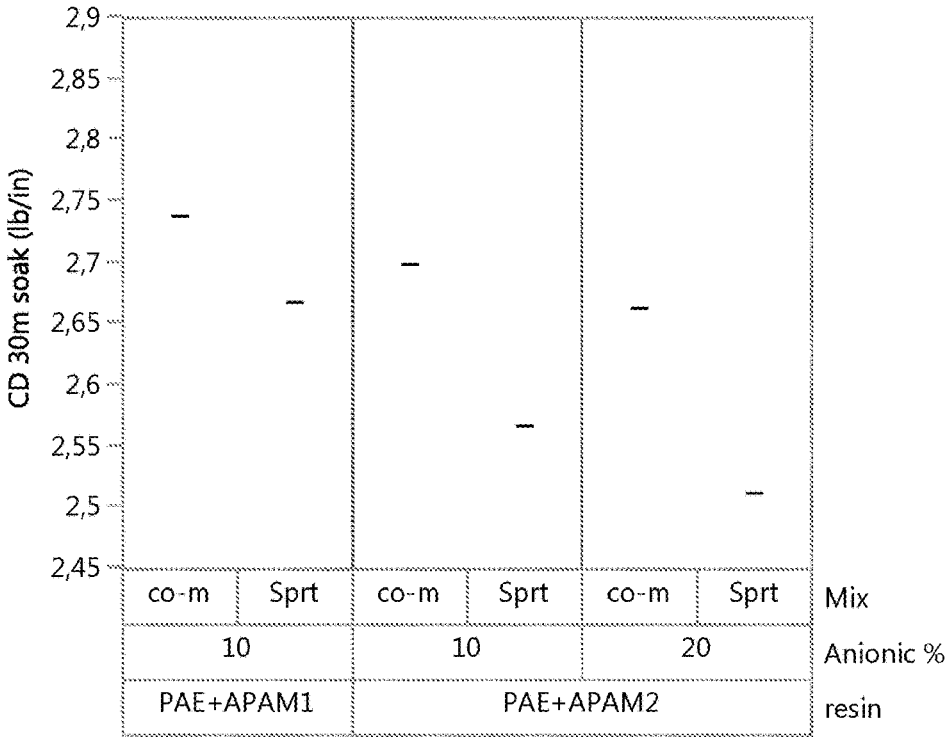
FIG. 3 shows a graph of the wet tensile strength cross-machine direction after 30 min soak, reflecting permanent wet tensile strength of the paper.

FIGS. 1 to 3 present the resultant dry and wet strength using the chemical programs co-mixed prior to addition to the aqueous pulp slurry compared to the programs adding sequentially at desired ratios. By the procedure of co-mixed composition, the results show 6.1% higher dry tensile, 7.3% higher immediate wet tensile, and 6.0% higher permanent wet tensile (wet tensile after 30 minute soak) than the programs dosing same chemicals in same amounts sequentially.

Figure 4:
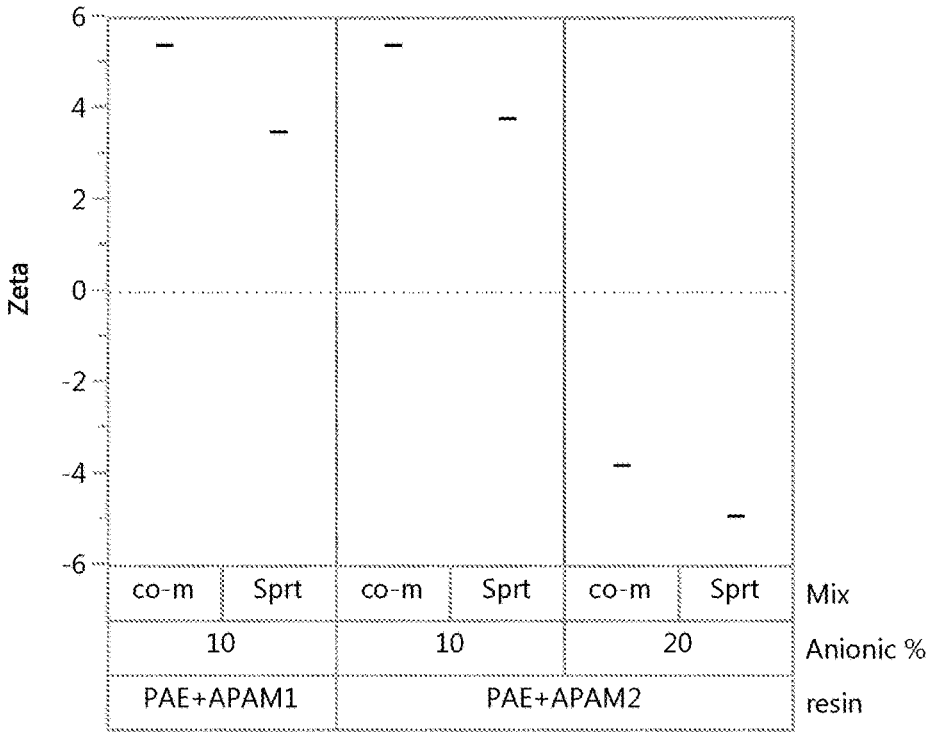
FIG. 4 shows a graph of the Zeta potential.

FIG. 4 presents the zeta potential (fiber surface charge) after chemical treatments. The programs co-mixed prior to addition to the aqueous pulp slurry showed more cationic or less anionic fiber surface charges than those programs involving adding same chemicals in same amounts sequentially. This is believed to indicate higher PAE wet strength resin absorption onto fibers.

The invention claimed is:

1. A method of making a paper comprising the steps of:

a) providing a cationic wet strength resin comprising a polyamidoamine epihalohydrin, a condensation copolymer of epihalohydrin and amine, or a combination thereof, b) providing an anionic polymer, c) co-mixing the cationic wet strength resin and the anionic polymer to provide a composition comprising polyelectrolyte complexes, d) providing an aqueous pulp slurry, draining the aqueous pulp slurry to form a wet fiber web, and drying the wet fiber web to obtain the paper, wherein said co-mixed composition is introduced to the aqueous pulp slurry or on the formed wet fiber web, and further wherein the anionic polymer has a standard viscosity of about 1.1 to 6 cP, measured at 0.1 weight-% polymer concentration in 1 M NaCl, at 25° C. and pH 8.0—8.5, using Brookfield DVII T viscometer.

2. The method according to claim 1, wherein the anionic polymer comprises an anionic synthetic polymer, an anionic polysaccharide, or any combination thereof.

3. The method according to claim 2, wherein the anionic synthetic polymer comprises a copolymer of non-ionic monomers and anionic monomers, a homopolymer of anionic monomers, a partially or completely hydrolysed poly(meth)acrylamide, an anionic glyoxalated polyacrylamide, or any combination thereof.

4. The method according to claim 3, wherein the copolymer of non-ionic monomer and anionic monomer has a molar ratio of anionic monomer to non-ionic monomer in the range of 5:95—95:5.

5. The method according to claim 2, wherein the anionic polysaccharide comprises anionic cellulose, anionic starch, anionic vegetable gum, anionic microfibrillar cellulose, or any combination thereof.

6. The method according to claim 1, wherein the anionic polymer has a charge density of about −0.1 to −10 meq/g (dry), as measured at pH 7.

7. The method according to claim 1, wherein the cationic wet strength resin has a weight average molecular weight of about 150 000 to 1 000 000 Dalton.

8. The method according to claim 1, wherein the cationic wet strength resin has a charge density of about 1.5 to 6.0 meq/g, as measured at pH 4.

9. The method according to claim 1, wherein the cationic wet strength resin comprises a polyamidoamine epihalohydrin resin.

10. The method according to claim 9, wherein the polyamidoamine epihalohydrin has an epihalohydrin:amine molar ratio of at least 0.80.

11. The method according to claim 1, wherein the weight ratio of the anionic polymer to the cationic wet strength resin is about 5:95 to 50:50.

12. The method according to claim 1, wherein the solids content of the cationic wet strength resin is at least 15 weight-%, before co-mixing with the anionic polymer.

13. The method according to claim 1, wherein the co-mixed composition of step c) is diluted with water before introducing to the aqueous pulp slurry or on the formed wet fiber web; preferably the co-mixed composition of step c) is diluted to a solids content of at most 5 weight-%.

14. The method according to claim 1, wherein the co-mixed composition has a net cationic charge, as measured at pH 4; preferably the co-mixed composition has a charge density of at least 0.01 meq/g, as measured at pH 4.

15. The method according to claim 1, wherein the co-mixed composition is introduced to the aqueous pulp slurry or on the formed wet fiber web at most 2 hours after initiation of co-mixing.

16. The method according to claim 1, wherein the paper is selected from tissue, towel, carrier board, linerboard, fluting, liquid packaging board, folding box board, solid bleached sulfate board, solid unbleached sulfate board, and white lined chipboard.

* * * * *